US006984215B2

(12) United States Patent
Shah et al.

(10) Patent No.: US 6,984,215 B2
(45) Date of Patent: Jan. 10, 2006

(54) APPARATUS AND METHOD FOR PROVIDING RAPID COMPRESSION TO AT LEAST ONE APPENDAGE

(75) Inventors: Preyas Shah, Warminster, PA (US); Mark Higgins, Perkasie, PA (US)

(73) Assignee: Rushabh Instruments, LLC, Warrington, PA (US)

( * ) Notice: Subject to any disclaimer, the term of this patent is extended or adjusted under 35 U.S.C. 154(b) by 0 days.

(21) Appl. No.: 10/857,425

(22) Filed: May 28, 2004

(65) Prior Publication Data

US 2004/0260218 A1 Dec. 23, 2004

Related U.S. Application Data

(60) Provisional application No. 60/479,315, filed on Jun. 18, 2003.

(51) Int. Cl.
*A61H 23/00* (2006.01)

(52) U.S. Cl. ..... 601/152; 601/150; 601/151

(58) Field of Classification Search ..... 601/148, 601/149, 150, 151, 152; 606/201, 202; 128/898, 128/DIG. 20
See application file for complete search history.

(56) References Cited

U.S. PATENT DOCUMENTS 3,961,625 A 6/1976 Dillon
4,269,175 A 5/1981 Dillon
4,343,302 A 8/1982 Dillon
4,590,925 A 5/1986 Dillon
4,753,226 A * 6/1988 Zheng et al. ..... 601/150
4,865,020 A * 9/1989 Bullard ..... 601/150
4,986,260 A * 1/1991 Iams et al. ..... 601/149
5,279,283 A 1/1994 Dillon
5,383,842 A * 1/1995 Bertini ..... 601/151
5,514,079 A 5/1996 Dillon
5,554,103 A 9/1996 Zheng et al.
5,997,540 A 12/1999 Zheng et al.
6,361,512 B1 * 3/2002 Mackay et al. ..... 601/150
6,572,621 B1 6/2003 Zheng et al.
6,589,267 B1 7/2003 Hui
6,645,165 B2 11/2003 Waldridge et al.
6,656,141 B1 12/2003 Reid
6,736,786 B1 * 5/2004 Shabty et al. ..... 601/152
2001/0018563 A1 8/2001 Waldridge et al.
2004/0064077 A1 4/2004 Dillon

* cited by examiner

*Primary Examiner*—Michael A. Brown
*Assistant Examiner*—Quang D. Thanh
(74) *Attorney, Agent, or Firm*—RatnerPrestia

(57) ABSTRACT

Methods and apparatus for providing rapid compression to at least one appendage positioned within an inflatable sleeve are disclosed. Rapid compression is provided by filling the inflatable sleeve containing the appendage with a gas. A portion of the gas is then repeatedly withdrawn and inserted back into the inflatable sleeve to apply a compression therapy to the at least one appendage.

17 Claims, 4 Drawing Sheets

APPARATUS AND METHOD FOR PROVIDING RAPID COMPRESSION TO AT LEAST ONE APPENDAGE

CROSS-REFERENCE TO RELATED APPLICATIONS

This application claims the benefit of the filing date of provisional application No. 60/479,315 entitled "RAPID COMPRESSION APPARATUS AND METHOD" filed Jun. 18, 2003, the contents of which are incorporated herein by reference.

FIELD OF THE INVENTION

The present invention relates to the field of medical devices and, more particularly, to methods and apparatus for providing rapid compression therapy treatments to at least one appendage, e.g., an arm or a leg, of a body.

BACKGROUND OF THE INVENTION

Compression therapy systems are used in several medical applications to apply rapid compressions to one or more appendages (e.g., arms, hands, legs, and feet) of a body. For example, compressions therapy systems are used to treat chronic wounds by applying pressure to an appendage having wounds to improve circulation around the wounds, or to improve blood circulation to treat angina or congestive heart failure (CHF), e.g., as in enhanced external counter-pulsation (EECP) devices.

In a conventional compression therapy system, a large compressor compresses air for storage in a storage tank. Moderate amounts of air from the storage tank are then delivered to an inflatable sleeve containing an affected appendage in rapid low pressure bursts to apply compression to the appendage. After each burst of air fills the inflatable sleeve, the inflatable sleeve is opened to release the air and, thus, remove the compression from the appendage. The compressor and storage tanks needed in such systems are loud, bulky, and expensive, making them unsuitable for use in the home. In addition, because of the volume of air required for conventional compression therapies, these systems are generally unable to treat more than one appendage at a time using power from ordinary household outlets (e.g., 1500 watts or less at 120 volts AC).

There is an ever present desire for more convenient and economical medical equipment. Accordingly, rapid compression apparatus and methods are needed that are not subject to the above limitations. The present invention addresses this need among others.

SUMMARY OF THE INVENTION

The present invention is embodied in methods and apparatus for providing rapid compression to at least one appendage positioned within an inflatable sleeve. Rapid compression is provided by filling the inflatable sleeve containing the appendage with a gas. A portion of the gas is then repeatedly withdrawn and inserted back into the inflatable sleeve to apply a compression therapy to the at least one appendage.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. This emphasizes that according to common practice, the various features of the drawings are not drawn to scale. On the contrary, the dimensions of the various features are arbitrarily expanded or reduced for clarity. Included in the drawings are the following figures.

DETAILED DESCRIPTION OF THE INVENTION

Figure 1:
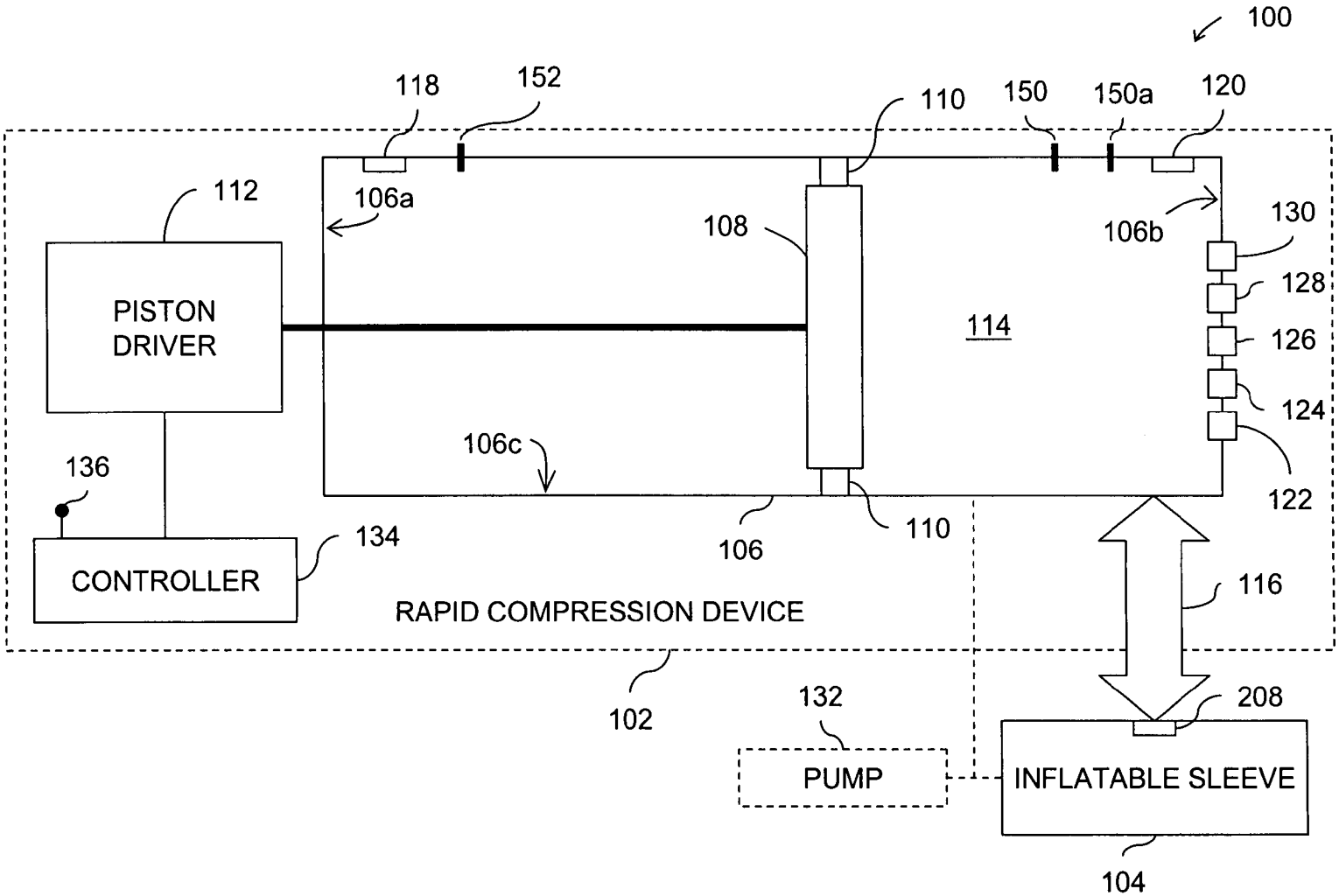
FIG. 1 is a block diagram of an exemplary rapid compression system in accordance with the present invention.

FIG. 1 is a block diagram of an exemplary rapid compression system 100 for applying rapid compression therapies on a patient's appendage (e.g., arm, leg, foot, hand, etc.). The illustrated rapid compression system 100 includes a rapid compression device 102 and at least one inflatable sleeve (represented by inflatable sleeve 104) for receiving an appendage. In general overview, an appendage is positioned within the inflatable sleeve 104 and the inflatable sleeve 104 is filled with gas (e.g., air) to apply pressure to the appendage. The rapid compression device 102 then cyclically withdraws a portion of the gas from the inflatable sleeve 104 to reduce the pressure on the appendage and reinserts the withdrawn portion of gas back into the inflatable sleeve 104 to increase the pressure on the appendage. Thus, the gas is reused to increase efficiency rather than being vented to the atmosphere during each cycle as in conventional systems.

Figure 2B:
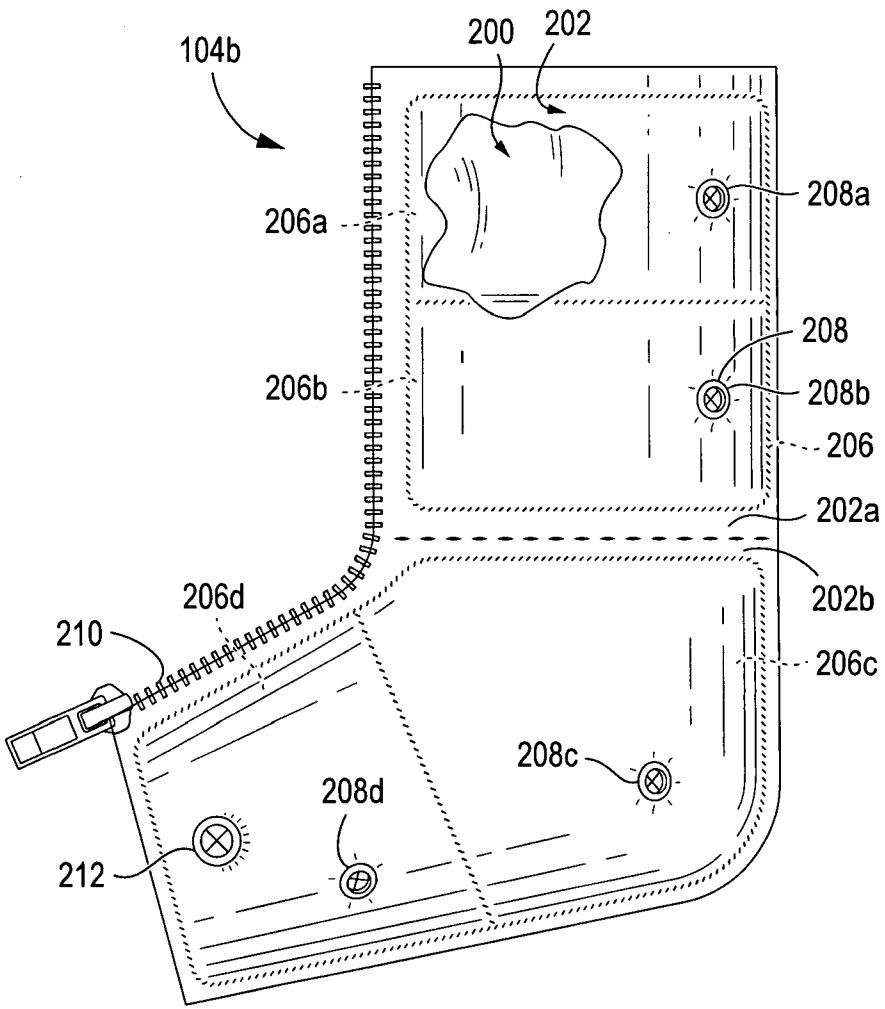
FIGS. 2A and 2B are illustrations of exemplary inflatable sleeves for applying pressure to an arm and a leg, respectively, in the exemplary rapid compression system of FIG. 1.
Figure 2A:
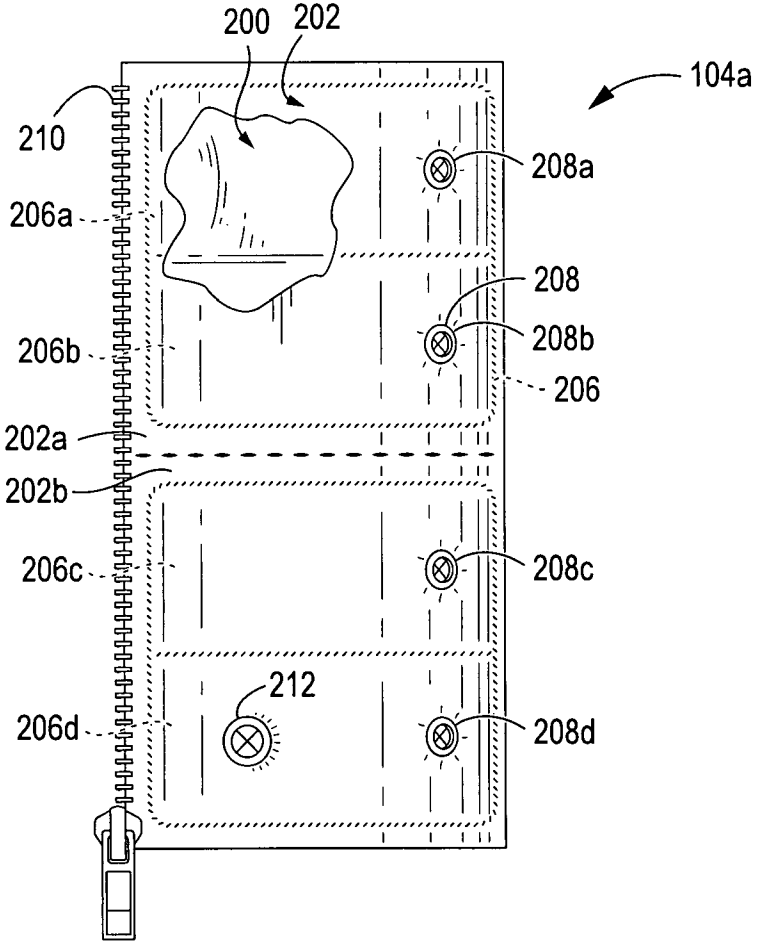

The present invention is now described in greater detail. FIG. 2A depicts an exemplary inflatable sleeve 104*a* for applying compression therapies to an arm and FIG. 2B depicts an exemplary inflatable sleeve 104*b* for applying compression therapies to a leg. The illustrated inflatable arm sleeve 104*a* is tubular in shape and is configured to receive an arm. The inflatable arm sleeve 104*a* includes a relatively soft inner layer 200 that inflates to conform to the appendage and a relatively rigid outer layer 202 that prevents the inner layer 200 from expanding outward when the inner layer 200 is inflated. The inner layer 200 at least partially defines a volume for receiving the gas, where the volume may be reduced by forces produced by the outer layer 202 and the appendage positioned within the sleeve 104*a*. The pressure of the gas within the volume of the inner layer 200 is physically applied to the appendage by the inner layer 200. The outer layer 202 may be a nylon fabric laminated with a polyurethane film.

In an exemplary embodiment, the inner layer 200 has a single inflatable section 206 with an opening 208 for coupling to the rapid compression device 102 (FIG. 1) to exchange gas. In this embodiment, the signal inflatable section 206 at least partially defines the volume for receiving the gas. In an alternative exemplary embodiment, the inner layer 200 may have a plurality of inflatable sections (represented by inflatable sections 206*a*, 206*b*, 206*c*, and 206*d*) and a plurality of openings (represented by 208*a*, 208*b*, 208*c*, and 208*d*). In this embodiment, a plurality of volumes (section volumes) for receiving the gas are defined by the sections. The plurality of inflatable sections may be physically coupled to or physically separated (either partially or fully) from one another. One or more of the plurality of inflatable sections may correspond to one or more outer layer sections (represented by outer layer sections 202*a* and 202*b*), which may be physically coupled to or physically separated (either partially or fully) from one another.

The sleeve 104*a* may have an optional zipper 210 to minimize application and removal time of the sleeve on the arm. In addition, the sleeve 104*a* may have one or more optional valves (represented by valve 212) to release excess pressure and to deflate the sleeve 104*a* for removal from the appendage and for storage. Inflatable leg sleeve 104*b* is similar to inflatable leg sleeve 104*a*, except in shape, with similar element being identically numbered, and will not be described in further detail.

Referring back to FIG. 1, the rapid compression device 102 includes a cylinder 106 and a sliding piston 108. The cylinder 106 has a first end 106*a* and a second end 106*b*. A piston seal 110 is positioned around the perimeter of the piston 108 to form a seal between the edges of the piston 108 and an interior wall 106*c* of the cylinder 106. In an exemplary embodiment, the cylinder 106 and the piston 108 each have a circular cross section. In alternative exemplary embodiments, the cylinder and piston may have cross sections with other shapes, e.g., oval, square, rectangular, triangular, or essentially any shape.

A piston driver 112 is coupled to the piston 108 to move the piston 108 back and forth within the cylinder 106 to alter the volume of a pressure cavity 114 within the cylinder 106 defined by the second end 106*b* of the cylinder 106 and the piston 108. In the illustrated embodiment, the piston driver 112 is coupled to a controller 134 (described below), which controls the piston driver 112 to move/position the piston 108 within the cylinder 106. In an exemplary embodiment, the piston driver 112 is configured to operate using power available from a conventional household outlet, e.g., 1500 watts or less at approximately 120V AC. In an alternative exemplary embodiment, other power sources may be used. A suitable piston driver for use with the present invention will be understood by one of skill in the art from the description herein.

The pressure cavity 114 is coupled directly to the inflatable sleeve 104 such that altering the volume of the pressure cavity 114 alters the pressure of the gas in the volume defined by the inflatable sleeve 104. In an exemplary embodiment, the valve 208 of the inflatable sleeve 104 is coupled to the pressure cavity 114 of the cylinder 106 via a gas transport connector 116 such as a flexible tube or other suitable means for transporting gas between the sleeve 104 and the rapid compression device 102. The gas transport connector 16 may have a diameter that permits the pressure of gas within the cavity 114 of the rapid compression device 102 and the pressure of gas with the inflatable sleeve 104 to equalize rapidly (e.g., within about 50–100 milliseconds). In an exemplary embodiment, the gas transport connector 116 is a flexible tube having a diameter of about at least two inches.

When the piston 108 is inserted into the cylinder 106 (i.e., moved toward the second end 106*b*), the volume of air within the cavity 114 goes down, thereby increasing the pressure in the cavity 114 and in the inflatable sleeve 104 coupled to the cylinder 106 due to a decrease in the combined volume of the cavity 114 and the inflatable sleeve 104. When the piston 108 is extracted from the cylinder 106 (i.e., moved toward the first end 106*a*), the volume of air within the cylinder 106 goes up, thereby decreasing the pressure in the cavity 114 and in the inflatable sleeve 104 coupled to the cylinder 106 due to the restored combined volume of the cavity 114 and the inflatable sleeve 104.

The illustrated rapid compression device 102 further includes a rear position sensor 118, a front position sensor 120, and a pressure sensor 122. In an exemplary embodiment, the rear position sensor 118 defines the maximum extraction point for the piston 108, the front position sensor 120 defines the maximum insertion point for the piston 108, and the distance between the sensors 118 and 120 defines a maximum stroke length for the piston 108 within the cylinder 106. The pressure sensor 122 senses the pressure in the cavity 114. Suitable position and pressure sensors for use in the present invention will be readily apparent to those of skill in the related arts.

In the illustrated embodiment, manual and automatic valves allow the flow of air in and/or out of the cavity 114. The illustrated embodiment includes a manual release valve 124, an air release solenoid valve 126, an excess pressure relief valve 128, and an air inlet valve 130. The manual release valve 124 opens manually to allow reduction of the pressure within the cavity 114. The air release solenoid valve 126 is a controlled device that opens, e.g., in response to signals from a controller, to allow reduction of the pressure within the cavity 114. The excess pressure relief valve 128 opens when the pressure within the cavity exceeds a predefined value to prevent potentially damaging pressure from developing in the cavity 114. The air inlet valve 130 is a controlled valve that opens to allow air flow into the cavity 114 when the piston 108 is extracted during an initialization phase, described in further detail below. In exemplary embodiments, an optional pump 132 (shown in phantom) initially supplies air to the inflatable sleeve 104 and/or the cavity 114 within the cylinder 106. The pump 132 may be a small pump having characteristics such as those found in aquarium pumps.

The controller 134 monitors and/or controls the sensors, valves (except for the manual release valve 124 and the excess pressure relief valve 128), and piston driver 112 to adjust the pressure/volume within the cavity 114, which, in turn, adjusts the pressure applied to an appendage within the inflatable sleeve 104. The controller 134 is programmed to control the pressure within the cavity 114 by changing the position of the piston 108 within the cylinder 106 via the piston drive 112. In an exemplary embodiment, the controller 134 is programmed with data corresponding to the piston driver 112, the piston 108, and the cylinder 106 that enables the controller 134 to determine the relative position of the piston 108 within the cylinder 106. In certain exemplary embodiments, the controller 134 monitors the rear position sensor 116 and the forward position sensor 118 and does not drive the piston 108 beyond locations corresponding to these sensors to avoid damaging the rapid compression device 102. In certain other exemplary embodiments, the forward and rear sensors are eliminated and the controller 134 is entrusted with this function. Connection lines between the controller 134 and the various sensors and valves are omitted to avoid clutter within FIG. 1. The controller 134 may be a microprocessor, microcontroller, state machine, logic gates, discrete components, integrated circuits, or essentially any device capable of processing signals. A suitable controller for use in the present invention will be readily apparent to those of skill in the related arts.

The controller 134 is programmed to vary the pressure/volume within the cavity 114 (and, thus, the inflatable sleeve 104) in accordance with various compression therapies. In an exemplary embodiment, the controller 134 is programmed to vary the pressure/volume in the cavity 114 in accordance with a predetermined program at a certain rate for a certain period of time, e.g., between 0 psi and 2 psi at sixty cycles per minute for twenty minutes. In an alternative exemplary embodiment, the controller 134 is programmed to vary the pressure/volume in the cavity responsive to a cardiac signal generated by the heart of a being associated with the appendage. In accordance with this embodiment, the controller may have an input port 136 for receiving the cardiac signal and may increase pressure (reduce volume) of the cavity 114 substantially concurrent with expansion of the heart and decrease pressure (increase volume) of the cavity 114 substantially concurrent with contraction of the heart.

The controller 134 may be programmed to apply the pressure in accordance with one or more pressure waveforms, e.g., a trapezoidal waveform, a triangular waveform, a step waveform, etc. Thus, the pressure may vary continuously or may be held for predetermined periods of time, e.g., at the maximum and/or minimum pressure. In certain exemplary embodiments, the pressure, compression rate, time, and/or pressure waveform are set by an operator using a conventional user interface such as a keypad or through a computer interface.

The controller 134 may apply different pressure levels during the course of the therapy with the time for each pressure level being programmable as well. For example, the controller 134 may be set to vary the pressure between 0 psi and 1 psi at sixty cycles per minute for ten minutes followed by varying the pressure between 0 and 2 psi at eighty cycles per minute (or responsive to a cardiac signal) for fifteen minutes. In addition, the controller 134 may apply pressure at a variable rate.

Figure 3:
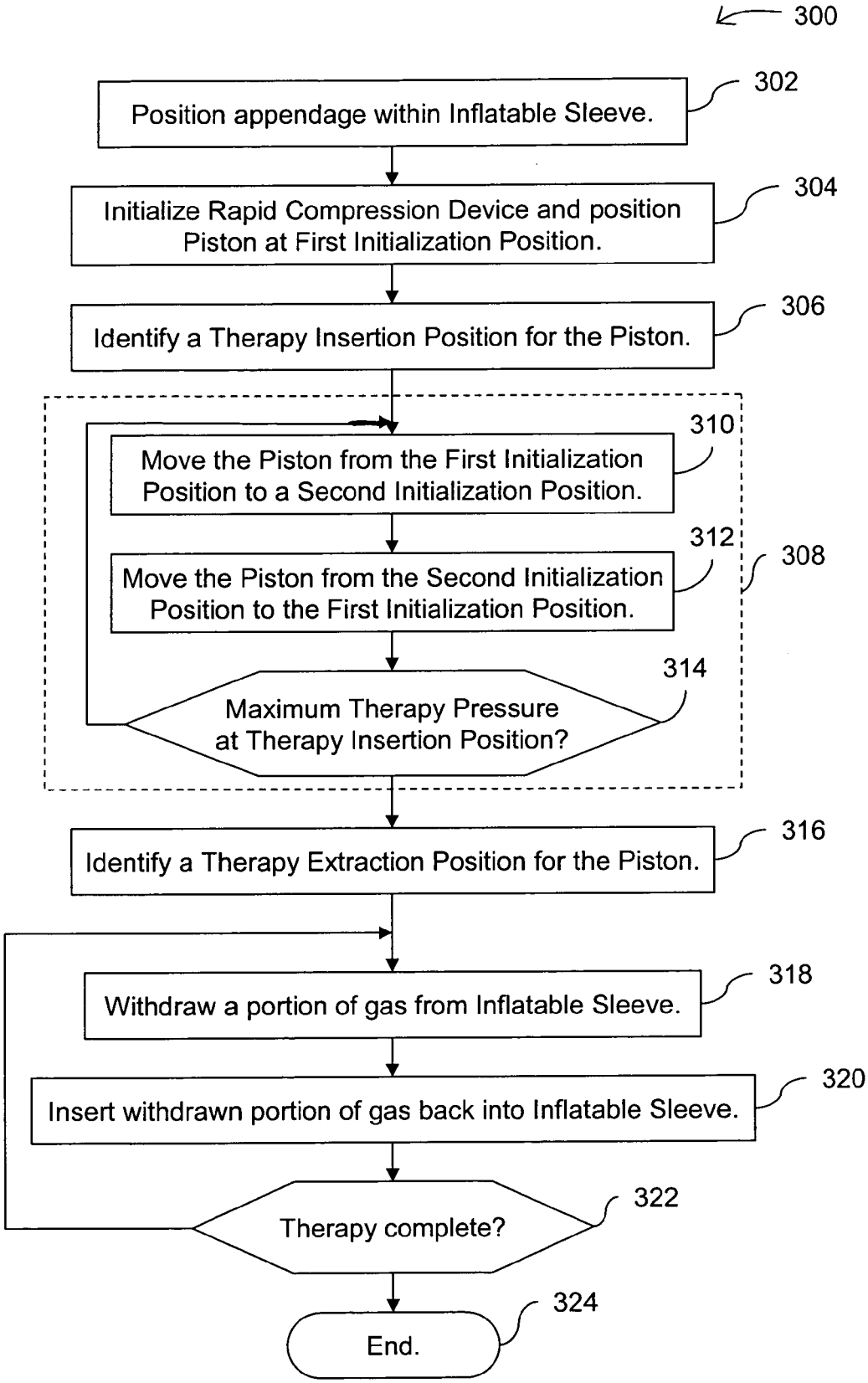
FIG. 3 is a flow chart depicting exemplary steps for applying pressure to an appendage in accordance with the present invention.

FIG. 3 is a flow chart 300 of exemplary steps for applying a compression therapy to an appendage using the rapid compression device 102 and the inflatable sleeve 104 of FIG. 1. At block 302, an appendage is positioned with the inflatable sleeve 104. For descriptive purposes, the invention is described with reference to a single inflatable sleeve, however, multiple inflatable sleeves may be employed for use with multiple appendages. For example, two leg inflatable sleeves and two arm inflatable sleeves may be concurrently used to apply a compression therapy to both arms and legs of a being simultaneously, with the gas for all four inflatable sleeves being controlled by a single rapid compression device 102.

At block 304, the rapid compression device is initialized. In an exemplary embodiment, the controller 134 (via the piston driver 112) positions the piston 108 at a front initialization position 150 (see FIG. 1), which is at or near the front position sensor 120, and opens all controlled valves, e.g., air release solenoid valve 126 and air inlet valve 130. In an exemplary embodiment, the front initialization position 150 is spaced from the maximum insertion position of the piston within the cylinder, which is near front position sensor 120, for reasons that are described in greater detail below.

At block 306, the controller 134 identifies a therapy insertion position for the piston within the cylinder. The therapy insertion position is an initial maximum position that the piston may be inserted into the cylinder during a therapy to develop the maximum therapy pressure. In an exemplary embodiment, the therapy insertion position is the front initialization position.

At block 308, the inflatable sleeve 104 is filled with gas. In an exemplary embodiment, the inflatable sleeve is filled with gas using the rapid compression device 102, which will be described in further detail below with reference to blocks 310, 312, and 316. In an alternative exemplary embodiment, the inflatable sleeve is filled with gas using an optional pump 132 instead of, or in addition to, the rapid compression device 102.

At block 310, the controller 134 moves the piston 108 from the first initialization position 150 to a second initialization position 152 within the cylinder 106 (which is at or near the rear position sensor 118) to draw air into the cavity 114. In an exemplary embodiment, the controller 134 opens the air inlet valve 130 (e.g., to expose the cavity to the atmosphere) and withdraws the piston 108 slowly from the inflatable sleeve to ensure that the cavity 114 is filled with gas (e.g., air) external to the rapid compression device 102 and the inflatable sleeve 104, rather than gas from the inflatable sleeve 104.

At block 312, the controller 134 closes the valves and slowly inserts the piston 108 into the cylinder 106 to the first initialization position 150 to fill the inflatable sleeve 104 with gas. In an exemplary embodiment, the controller 134 monitors the pressure within the cavity 114 while the piston 108 is moved forward to ensure that the pressure within the inflatable sleeve 104 does not exceed a predefined maximum therapy pressure level (e.g., 2 psi). If the pressure exceeds the maximum therapy level, the controller may open a valve to release excess pressure as the piston is inserted into the cylinder.

At block 314, the controller 134 determines if a maximum therapy pressure within the cavity with the piston at the therapy insertion position (e.g., first initialization position 150) is met. If the maximum therapy pressure in the cavity is met, processing proceeds at block 316. In an exemplary embodiment, if the desired pressure in the cavity is not met, processing proceeds at block 310 with the steps in blocks 310 and 312 repeated until there is enough air in the cavity 114 and the inflatable sleeve 104 to develop the maximum therapy pressure at the therapy insertion position. For example, if the inflatable sleeve needs 6 liters of air and the rapid compression device 102 can deliver 2 liters of air per stroke, the rapid compression device 102 will cycle at least three times to fill the inflatable sleeve 140.

At block 316, the controller 134 identifies a therapy extraction position for the piston 108 within the cylinder 106. In an exemplary embodiment, the controller 134 monitors the pressure within the cavity 114 while the piston 108 is extracted from the cylinder 106 until a minimum therapy pressure is met (e.g., 0 psi). The controller 134 then identifies the position of the piston 108 when the minimum therapy pressure is met as the therapy extraction position. In an exemplary embodiment, the controller identifies the position of the therapy extraction position relative to the therapy insertion position.

At block 318, the rapid compression device 102 withdraws a portion of the gas from the inflatable sleeve into a cavity (e.g., the gas transport connector 116 and/or the cavity 114). In an exemplary embodiment, the controller 134 moves the piston 108 from the therapy insertion position to the therapy extraction position to increase the volume of the cavity 114, thereby drawing a portion of the gas from the inflatable sleeve into the cavity to reduce the pressure in the inflatable sleeve.

At block 320, the rapid compression device 102 inserts the withdrawn portion of the gas from the cavity (e.g., the gas transport connector 116 and/or the cavity 114) back into the inflatable sleeve. In an exemplary embodiment, the controller 134 moves the piston 108 from the therapy extraction position to the therapy insertion position to decrease the volume of the cavity 114, thereby inserting the withdrawn portion of the gas back into the inflatable sleeve to increase the pressure in the inflatable sleeve.

At block 322, the controller 134 determines if the therapy is complete. If the therapy is complete, processing ends at block 324. If the therapy is not complete, processing proceeds at block 318 with blocks 318 and 320 rapidly repeated until the therapy is complete. In an exemplary embodiment, the controller 134 performs the steps of blocks 318 and 320 to apply the therapy to the appendage such that the piston is cycled rapidly between the first and second therapy positions at a predetermined rate, e.g., between 30 and 120 cycles per minute. In an alternative exemplary embodiment, the piston is cycled responsive to an external signal, e.g., a cardiac signal produced by the heart of a being whose appendage is being treated. In accordance with this embodiment, the controller 134 may control the piston driver 112 such that the piston 108 is inserted into the cylinder 106 to increase the applied pressure substantially concurrent with (or in anticipation of) expansion of the heart and the piston 108 is withdrawn from the cylinder 106 to decrease the applied pressure substantially concurrent with (or in anticipation of) contraction of the heart.

In an exemplary embodiments, the controller 134 monitors the pressure in the cavity 114 and increases or decreases the stroke length (e.g., by shifting the therapy insertion position and/or the therapy extraction position) responsive to the monitored pressure such that the desired minimum and maximum pressures are maintained throughout the therapy. For example, if the pressure produced when the piston is positioned at the therapy insertion position is below the maximum therapy pressure (e.g., due to leaks within the system), the controller may reposition the therapy insertion position 150 closer to the maximum insertion position to decrease the volume of the cavity 114 and increase the pressure when piston is at the new therapy insertion position 150*a* (see FIG. 1).

After the maximum therapy pressure is developed within the pressure cavity 114 with the piston 108 at the therapy insertion position 150 within the cylinder 106, the rapid compression device 102 can alter the pressure applied to an appendage within the inflatable sleeve 104 simply by moving the piston within the cylinder between the therapy insertion and extraction positions. Thus, the rapid compression device is able to deliver rapid compressions to an appendage in a more efficient manner by reusing the air rather than releasing the air and then completely replenishing the air in the inflatable sleeve as in conventional systems.

Additional details regarding the rapid compression device are now provided. Assuming an inflatable sleeve (hereinafter sleeve) with a 15 liter volume, only $1/15^{th}$ of the volume of the sleeve needs to be displaced by the piston 108 within the cylinder 106 to develop 1 psi of pressure. Typical pressure therapies are performed with a maximum of 1 to 2 psi of pressure. Based on this information, the desired displacement will typically be no more than 2 liters for a 15 liter sleeve to be pressurized at 2 psi. A 5" diameter piston will have to move only 3.25" inches to develop 1 psi in a 15-liter sleeve. This distance traveled over a period of 300 milliseconds translates into a system that moves at a speed of approximately 10 inches per second.

Exemplary volume calculations follow to illustrate that moving a 5 inch diameter piston 3 and ½ inches will displace 1 liter of air and moving the piston 7 inches will displace 2 liters of air.

$$5'' \text{ diameter piston has an area} = \text{pi} * \text{radius} * \text{radius}$$
$$= 3.14 * 2.5 * 2.5$$
$$= 19.63 \text{ sq. inches}$$
$$\text{Volume of } 5'' \text{ diameter.} \times 3.5'' \text{ length} = 19.63 * 3.5$$
$$= 62.72 \text{ cubic inches}$$
$$1 \text{ cubic inch} = 2.54 \text{ cm} * 2.54 \text{ cm} * 2.54 \text{ cm}$$
$$= 16.387 \text{ cubic centimeters (cc)}$$
$$62.72 \text{ cubic inches} = 1027.79 \text{ cc}$$
$$= 1.027 \text{ liters}$$

Thus, to displace 1 liter, an approximately 3.5" translation of a 5" diameter piston is necessary and to displace 2 liters twice as much translation is necessary, e.g., 7". The development of suitable piston driver 112 to provide the necessary translation will be readily apparent to those of skill in the art.

Exemplary pressure calculations follow to illustrate that displacing one liter of air in a 15 liter inflatable sleeve develops approximately 1 psi and displacing two liters of air in a 15 liter inflatable sleeve develops approximately 2 psi. Pressure, volume and temperature of a given gas are related as shown in equation 1.

$$p1*v1/t1=p2*v2/t2, \quad (1)$$

where p1, v1 and t1 are pressure, volume and temperature before the compression, respectively, and p2, v2 and t2 are the pressure, volume and temperature after compression, respectively.

Assuming t1=t2 (which is a valid assumption for low pressure differentials, e.g., 1–2 psi), and atmospheric pressure=15 psi, when we develop 1 psi above atmospheric pressure, we develop actually 16 psi absolute pressure in the inflatable sleeve where it used to be 15 psi.

Thus, if we start with 16 liters (15 liters in the inflatable sleeve plus 1 liter in the cylinder) and compress that extra 1 liter into the inflatable sleeve and solve for p2 we get:

$$p1*v1=p2*v2$$

$$15*16=p2*15$$

p2=16 (or 1 psi above atmospheric pressure)

Thus, adding 1 liter of air to a 15 liter inflatable sleeve raises the pressure by 1 psi and adding 2 liters of air (v1=17) raises the pressure by 2 psi. It will be readily apparent to those of skill in the art that pressure may be represented in units other than psi, e.g., millimeters of mercury (1 psi=50 mm of Hg) or inches of water (1 psi=27.7" of water).

Based on the information provided above, a compression therapy can be applied to a single arm or leg in a 15 liter inflatable sleeve (which is a relatively large inflatable sleeve compared to a typical inflatable sleeve having a volume of 5 liters or less) using approximately 300 watts of power. Thus, four appendage (e.g., two arm and two legs) can be treated concurrently using only 1200 watts of power or less, which is well within the power (1500 watts at 120V AC) available in a typical residential home. In addition, the rapid compression device is smaller, cheaper, and quieter than conventional compression devices, which makes them better suited for use in residential homes and in medical facilities.

Figure 4:
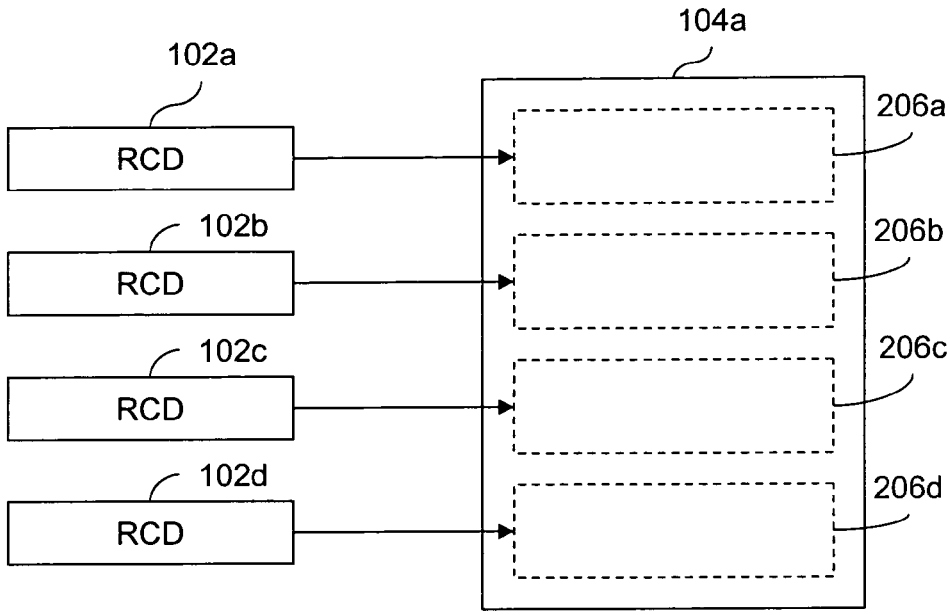
FIG. 4 is a block diagram of an alternative exemplary rapid compression system in accordance with the present invention.

Although the invention is described herein primarily with reference to a single rapid compression device 102 controlling the pressure of an inflatable sleeve 104 having a single inflatable section 206, the present invention may be applied to inflatable sleeves having multiple inflatable sections. In an exemplary embodiment, as depicted in FIG. 4, each of a plurality of rapid compression devices (e.g., RCDs 102*a–d*) are coupled to one or more respective sections (e.g., sections 206*a–d* of inflatable sleeve 104*a*). To regulate the pressure in a section volume of a particular section (e.g., section 206*a*), the controller 134 controls the piston driver of a respective rapid compression device (e.g., RCD 102*a*) to position the piston within the cylinder to regulate the cavity volume of the pressure cavity. This embodiment increases the number of components needed to regulate the pressure of an inflatable sleeve, however, smaller components may be employed due to the workload being divided across the multiple sections. In accordance with this embodiment, the controller may delay one RCD 102 with respect to another to non-uniformly apply pressure to the appendage throughout the sleeve. For example, to encourage fluid flow out of the leg, the controller may be configured to apply pressure to a section of the sleeve surrounding the foot, followed by the ankle, followed by the calf.

Figure 5:
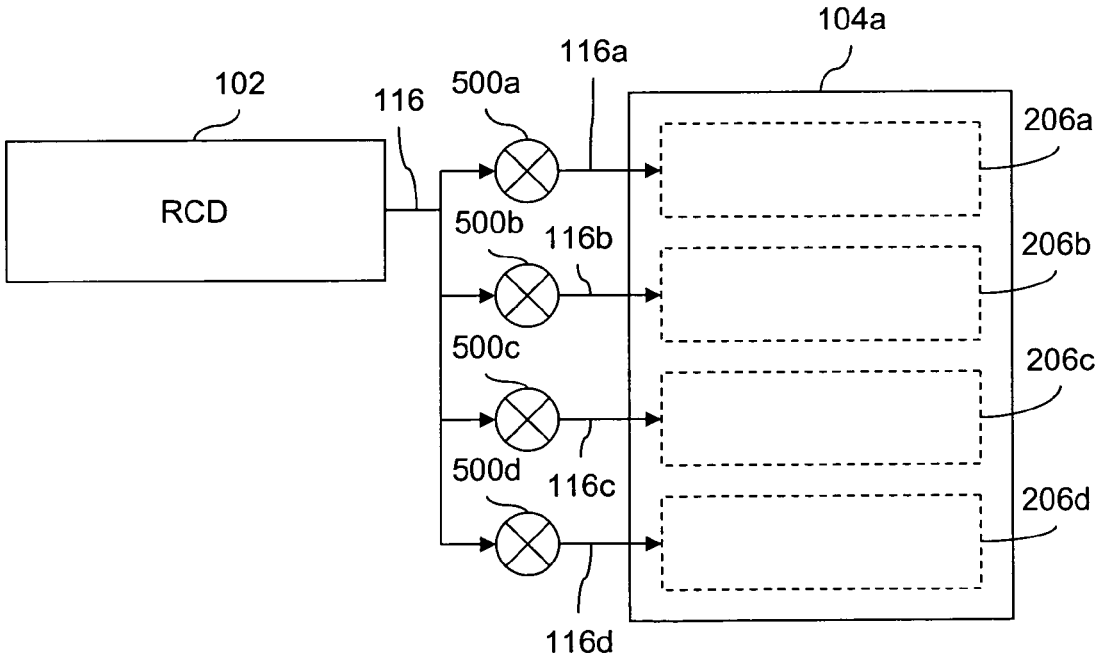
FIG. 5 is a block diagram of an alternative exemplary rapid compression system in accordance with the present invention.

In an alternative exemplary embodiment, as depicted in FIG. 5, a single rapid compression device (RCD) 102 is coupled to a plurality of sections (e.g., sections 206*a–d*) of an inflatable sleeve 104*a*. In an exemplary embodiment, the gas transport connector 116 contains gas transport branches (e.g., branches 116*a–d*) to individual sections (e.g., sections 206*a–d*) of the inflatable sleeve 104*a*. Controlled valves (e.g., valves 500*a–d*), which may be controlled by the controller 134, are positioned within the branches. To regulate the pressure of the section volume in a particular section (e.g., section 206*a*), the controller 134 selectively controls the appropriate valve (e.g., valve 500*a*) in conjunction with the piston driver of the rapid compression device 102 to position the piston within the cylinder to regulate the pressure in the cavity volume of the pressure cavity. The controller may generate one or more valve control signals for controlling the valves 500. The controller 134 may delay opening/closing one valve with respect to another to non-uniformly apply pressure to the appendage throughout the sleeve.

In an exemplary embodiment, the same pressure may be applied to multiple appendages and/or sections simultaneously. In alternative exemplary embodiments, different pressures are applied concurrently to different appendages and/or sections. For example, the rapid compression device 102 may apply 75 mm of Hg to a patient's legs and 50 mm of Hg to the patient's arms. In an exemplary embodiment, a controlled valve (such as valve 500*a*) is positioned between the rapid compression device 102 and each inflatable sleeve 104 (or individual sections 206 of sleeves) that receives an appendage to enable the application of different pressures.

Although the invention is illustrated and described herein with reference to specific embodiments, the invention is not intended to be limited to the details shown. For example, pressure may be sensed in the inflatable sleeve rather than in the cavity within the cylinder of the rapid compression device. Various other modifications may be made in the details within the scope and range of equivalents of the claims and without departing from the invention.

What is claimed:

1. A method for providing rapid compression to at least one appendage, the method comprising the steps of:

(a) positioning the at least appendage within an inflatable sleeve using a cylinder having a first end and a second end and a piston movably positioned within the cylinder between the fist end and the second end to define a pressure cavity having a volume coupled to the inflatable sleeve;

(b) filling the inflatable sleeve with a gas;

(c) withdrawing the piston from the cylinder from a first position within the cylinder to a second position to withdraw a portion of the gas from the inflatable sleeve into a cavity a distance between the first position and the second position defining a stroke length for the piston within the cylinder;

(d) inserting the piston into the cylinder from the second position to the first position to insert the withdrawn portion of gas from the cavity back into the inflatable sleeve;

(e) repeating steps (c) and (d) to apply a compression therapy to the at least one appendage;

(f) monitoring a pressure associated with the inflatable sleeve;

(g) altering at least one of (i) the first position and (ii) the second position responsive to the monitored pressure to adjust in different intervals the stroke length of the piston within the cylinder to accommodate pressure fluctuations; and (h) monitoring a front position of the piston and a rear position of the piston within the cylinder.

2. The method of claim 1, wherein steps (b) and (c) are performed responsive to a predefined program.

3. The method of claim 1, wherein the appendage is associated with a being having a cardiac signal and wherein the steps (b) and (c) are performed responsive to the cardiac signal.

4. The method of claim 3, wherein the cardiac signal is associated with a heart of the being and wherein step (b) is performed substantially concurrent with contraction of the heart and step (c) is performed substantially concurrent with expansion of the heart.

5. The method of claim 1, wherein the cylinder further comprises a valve having a least an open state and a closed state, the valve positioned to expose the pressure cavity to an atmosphere when in the open state, wherein step (a) comprises the steps of:

(i) withdrawing the piston from the cylinder from a third position to a fourth position with the valve open;

(ii) inserting the piston into the cylinder from the fourth position to the third position with the valve closed; and (iii) repeating steps (i) and (ii) until a predetermined pressure associated with the inflatable sleeve is met prior to applying the comoression therapy.

6. An apparatus for providing rapid compression to at least one appendage, the apparatus comprising:

at least one inflatable sleeve for receiving the at least one appendage, the at least one inflatable sleeve having a first volume for receiving a gas, the gas within the first volume having a pressure that is applied to the appendage;

a cylinder having a first end and a second end;

a piston movably positioned within the cylinder between the first end and the second end to define a pressure cavity within the cylinder between the piston and the second end of the cylinder, the pressure cavity having a second volume for receiving the gas, the pressure cavity being continuously coupled to the at least one inflatable sleeve such that altering the second volume by moving the piston alters the pressure of the gas within the first volume, the piston having a stroke length within the cylinder;

a pressure sensor positioned to sense the pressure of the gas;

a rear position sensor positioned adjacent the first end of the cylinder to sense the piston;

a front position sensor positioned adjacent the second end of the cylinder to sense the piston;

a positionable piston driver coupled to the piston, the positionable piston driver positioning the piston within the cylinder and adjusting in different intervals said stroke length of the piston within the cylinder based at least in part on the sensed pressure of the gas to accommodate pressure fluctuation, the positionable piston driver responsive to a control signal;

a controller coupled to the piston driver and to the pressure sensor, the controller generating the control signal for the positionable piston driver to position the piston within the cylinder to control the pressure of the gas within the first volume responsive at least in part to the sensed pressure of the gas;

wherein the pressure of the gas in the first volume is increased by inserting the piston into the cylinder to decrease the second volume and the pressure in the first volume is decreased by withdrawing the piston from the cylinder to increase the second volume.

7. The apparatus of claim 1, wherein the controller is configured to control the pressure of the gas within the first volume responsive to a predefined therapy program.

8. The apparatus of claim 1, wherein the appendage is associated with a being having a cardiac signal and wherein the controller is configured to receive the cardiac signal and to control the pressure of the gas within the first volume responsive to the cardiac signal.

9. The apparatus of claim 8, wherein the cardiac signal indicates expansion and contraction of a heart associated with the being and wherein the controller is configured to control the pressure of the gas within the first volume responsive to the cardiac signal such that the pressure is increased substantially concurrent with the expansion of the heart and the pressure is decreased substantially concurrent with the contraction of the heart.

10. The apparatus of claim 1, further comprising:

a valve coupled to the controller, the valve having a least an open state and a closed state selectable by the controller, the valve positioned to expose at least one of (i) the first volume and (ii) the second volume to an atmospheric pressure when in the open state;

wherein the controller is further configured to select when the valve is in the open state responsive to the position of the piston and the sensed pressure.

11. The apparatus of claim 1, further comprising:

a pump coupled to the controller and to at least one of (i) the inflatable sleeve and (ii) the pressure cavity, the pump configured to initialize the pressure of the gas.

12. The apparatus of claim 1, wherein the controller is configured to apply a therapy to the at least one appendage.

13. The apparatus of claim 1, wherein the at least one inflatable sleeve includes at least two inflatable sleeves for receiving at least two respective appendages.

14. The apparatus of claim 1, wherein the at least one inflatable sleeve includes at least four inflatable sleeves for receive at least four respective appendage.

15. The apparatus of claim 1, wherein the piston driver is configured to operate using less than 1500 watts at 120 volts AC.

16. An apparatus for providing rapid compression to at least one appendage, the apparatus comprising:

an inflatable sleeve for receiving an appendage, the inflatable sleeve having a plurality of sections, each of the sections having a respective section volume for receiving a gas, the gas within each of the sections having a pressure that is applied to the appendage;

at least one cylinder associated with a respective one of the sections, each of the at least one cylinder having a first end and a second end at least one piston, each of the at least one piston movably positioned within a respective one of the at least one cylinder between the first end and the second end to define a pressure cavity within the respective cylinder between the piston and the second end of the cylinder, the pressure cavity having a cavity volume for receiving the gas, the pressure cavity being continuously coupled to a respective section of the inflatable sleeve such that altering the cavity volume by moving the piston alters the pressure of the gas within the section volume of the respective section, the at least one piston having a stroke length within the respective one of the at least one cylinder;

at least one piston driver, each of the at least one piston driver coupled to a respective one of the at least one piston, each of the at least one piston driver configured to position the respective piston within the respective cylinder responsive to a control signal; and at least one rear position sensor positioned adjacent the first end of the at least one cylinder to sense the respective piston;

at least one front position sensor positioned adjacent the second end of the at least one cylinder to sense the respective piston;

a controller coupled to the at least one piston driver, the controller configured to generate the control signals for positioning the at least one piston within the respective at least one cylinder to adjust the stroke length in different intervals to independently control the pressure of the gas within the section volumes of each of the inflatable sleeve sections;

wherein the pressure of the gas within each section is increased by inserting the respective at least one piston into the respective at least one cylinder to decrease the cavity volume and the pressure is decreased by withdrawing the respective at least one piston from the respective at least one cylinder to increase the cavity volume.

17. The apparatus of claim 16, wherein the controller is configured to delay one of the at least one pistons within a respective one of the at least one cylinder with respect to another piston and respective cylinder.

* * * * *